US009681713B2

(12) United States Patent
Pao

(10) Patent No.: US 9,681,713 B2
(45) Date of Patent: Jun. 20, 2017

(54) FOLDABLE CHAIR AND CANE, WITH A LOCKING STRUCTURE

(71) Applicant: STEP2GOLD CO., LTD., Taichung (TW)

(72) Inventor: Chih-Ting Pao, Taichung (TW)

(73) Assignee: STEP2GOLD CO., LTD., Taichung (TW)

( * ) Notice: Subject to any disclaimer, the term of this patent is extended or adjusted under 35 U.S.C. 154(b) by 154 days.

(21) Appl. No.: 14/645,341

(22) Filed: Mar. 11, 2015

(65) Prior Publication Data

US 2015/0265012 A1 Sep. 24, 2015

(30) Foreign Application Priority Data

Mar. 18, 2014 (TW) ..... 103110140 A

(51) Int. Cl.
*A45B 5/00* (2006.01)
*A45B 9/00* (2006.01)
*A47C 4/04* (2006.01)

(52) U.S. Cl.
CPC ..... *A45B 5/00* (2013.01); *A45B 2009/007* (2013.01); *Y10T 74/20636* (2015.01)

(58) Field of Classification Search
CPC ..... A45B 5/00; A45B 2009/007; Y10T 74/20636
See application file for complete search history.

(56) References Cited

U.S. PATENT DOCUMENTS 2,133,047 A * 10/1938 Sheldon ..... A45B 5/00 248/155
2,380,437 A * 7/1945 Homrighausen ..... A61H 3/00 297/118
2,629,429 A * 2/1953 Baumfeld ..... A47C 9/105 297/118
3,266,839 A * 8/1966 Combs ..... A47C 9/105 248/155
3,537,748 A * 11/1970 Knapp ..... A47C 4/20 248/155
3,643,292 A 2/1972 Mayer
5,871,025 A * 2/1999 Richter ..... A45B 3/00 135/65
5,984,245 A * 11/1999 Hsu ..... F16C 11/10 248/164
6,899,388 B1 * 5/2005 Enrique ..... A47C 7/66 297/129
7,753,610 B2 * 7/2010 Gehrke ..... A47C 20/021 403/109.3
8,876,203 B1 * 11/2014 Haertl ..... A47C 4/04 297/118

* cited by examiner

*Primary Examiner* — David R Dunn
*Assistant Examiner* — Tania Abraham
(74) *Attorney, Agent, or Firm* — Blakely Sokoloff Taylor & Zafman LLP

(57) ABSTRACT

A foldable chair includes a main stick, a fold unit and a retention unit. The fold unit includes a middle slider member movable along the main stick between lower and upper positions, and a foldable support leg connected to the middle slider members. The retention unit is configured to prevent fold operation of the support leg when the middle slider member is at the lower position, and to permit the fold operation of the support leg when the middle slider member is at the upper position.

18 Claims, 10 Drawing Sheets

FOLDABLE CHAIR AND CANE, WITH A LOCKING STRUCTURE

CROSS-REFERENCE TO RELATED APPLICATIONS

This application claims priority of Taiwanese Application No. 103110140, filed on Mar. 18, 2014.

FIELD OF THE DISCLOSURE

The disclosure relates to a chair, more particularly to a foldable chair.

BACKGROUND OF THE DISCLOSURE

A foldable chair may be configured as a walking stick chair for use of people having inferior physical condition. Taiwanese Patent Application No. 102112330 discloses a conventional walking stick chair including a stick and a sleeve that is slidable along the stick. The conventional walking stick chair is convertible between a folded state and an unfolded state by moving the sleeve along the stick. The sleeve can be positioned relative to the stick for retaining the conventional walking stick chair in the folded or unfolded state. However, positioning of the sleeve relative to the stick can only indirectly keep a support leg of the conventional walking stick chair in folded or unfolded state. That is, the support leg may not be retained steadily at a predetermined position relative to the stick when the sleeve is positioned.

SUMMARY OF THE DISCLOSURE

Therefore, the object of the present disclosure is to provide a foldable chair that can overcome the aforesaid drawbacks associated with the prior art.

Accordingly, a foldable chair of the present disclosure includes a main stick, a fold unit, a seat unit and a retention unit. The main stick includes a rod body that extends along an axis. The seat unit is connected to the rod body. The fold unit includes a middle slider member and a leg unit. The middle slider member is movable along the rod body between a lower position and an upper position that is located above the lower position. The leg unit includes at least one support leg that includes an upper leg component connected pivotally to the middle slider member, a lower leg component connected pivotally to the upper leg component, and a drive link having opposite ends that are connected respectively and pivotally to the seat unit and the upper leg component. The seat unit is operable to drive movement of the drive link so as to convert the fold unit between an unfolded state where a free end of the lower leg component is distal from the rod body and the upper leg component, and a folded state where the free end of the lower leg component is proximate to the rod body and the upper leg component, such that when the fold unit is converted from the unfolded state into the folded state, the free end of the lower leg component pivots toward the upper leg component. The retention unit includes at least one locking structure that includes a latch member, a pull cord and a block member. The latch member is connected movably to the upper leg component. The pull cord has a first end portion that is connected to the latch member, and a second end portion that is opposite to the first end portion and that is connected to the middle slider member. The block member is connected co-movably to the lower leg component, and has a pivot axis about which the lower leg component is pivotable relative to the upper leg component, a contact surface that extends around the pivot axis, and an engaging surface that is connected to the contact surface. A distance between the engaging surface and the pivot axis is smaller than that between the contact surface and the pivot axis. When the middle slider member is at the lower position and the fold unit is in the unfolded state, the latch member abuts against the engaging surface for preventing the lower leg component from pivoting relative to the upper leg component so as to keep the support leg unfolded. When the middle slider member is moved to the upper position, the pull cord is configured to be driven to separate the latch member from the engaging surface for permitting the lower leg component to pivot relative to the upper leg component so as to permit conversion of the fold unit from the unfolded state to the folded state.

Another object of the present disclosure is to provide a locking structure.

Accordingly, a locking structure of the present disclosure is used in a foldable linkage unit. The linkage unit includes pivotally-interconnected first and second links. The locking structure includes a latch member and a block member. The latch member is connected movably to the first link. The block member is connected co-movably to the second link, and has a pivot axis about which the second link is pivotable relative to the first link, a contact surface that extends around the pivot axis, and an engaging surface that is connected to the contact surface. A distance between the engaging surface and the pivot axis is smaller than that between the contact surface and the pivot axis. The latch member is operable to abut against the engaging surface for preventing the second link from pivoting relative to the first link, and to be separated from the engaging surface for permitting the second link to pivot relative to the first link.

BRIEF DESCRIPTION OF THE DRAWINGS

Other features and advantages of the present disclosure will become apparent in the following detailed description of the embodiment with reference to the accompanying drawings, of which.

DETAILED DESCRIPTION OF THE EMBODIMENT

Figure 1:
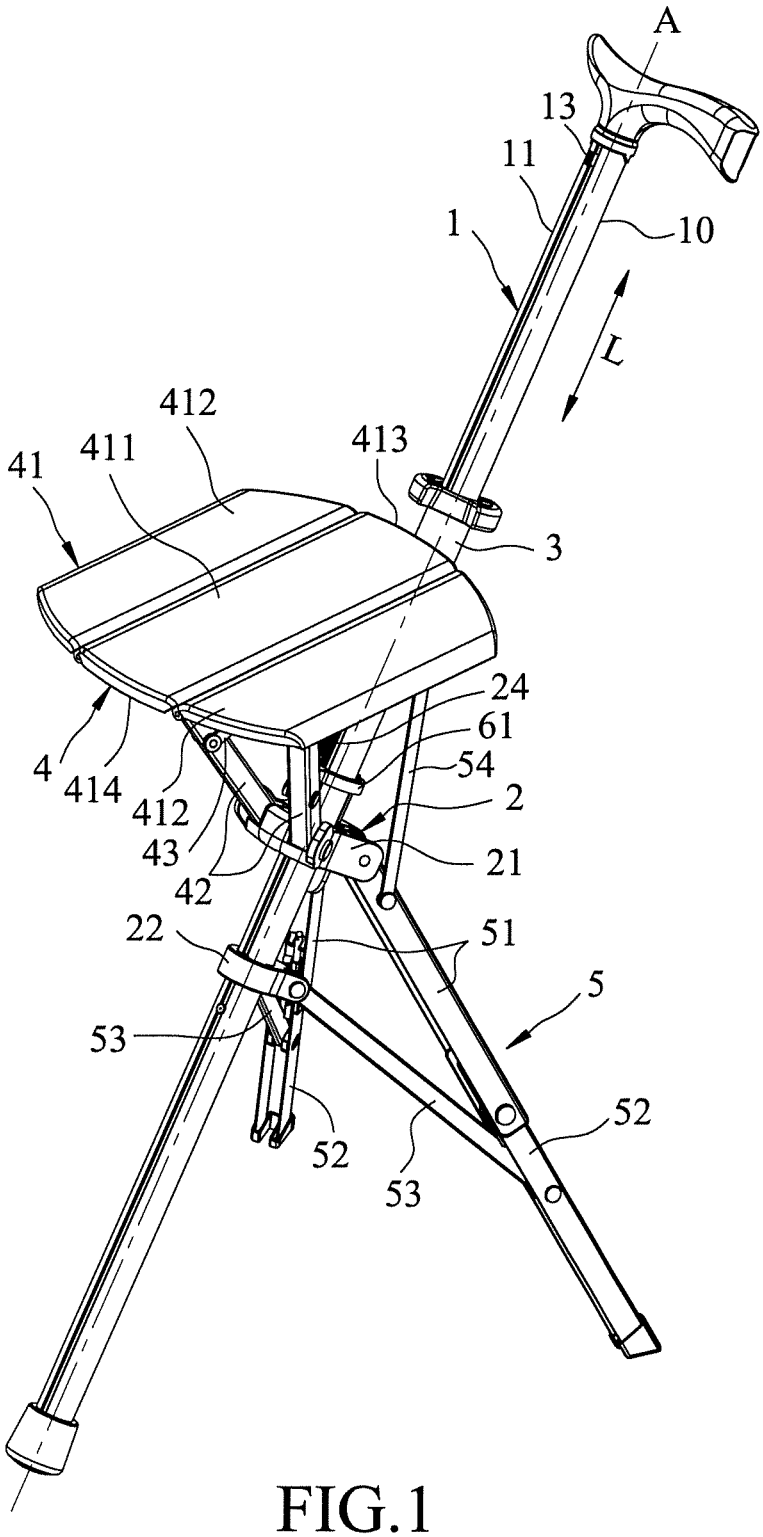
FIG. 1 is a perspective view of an embodiment of a foldable chair according to the disclosure, illustrating the foldable chair being unfolded.
Figure 2:
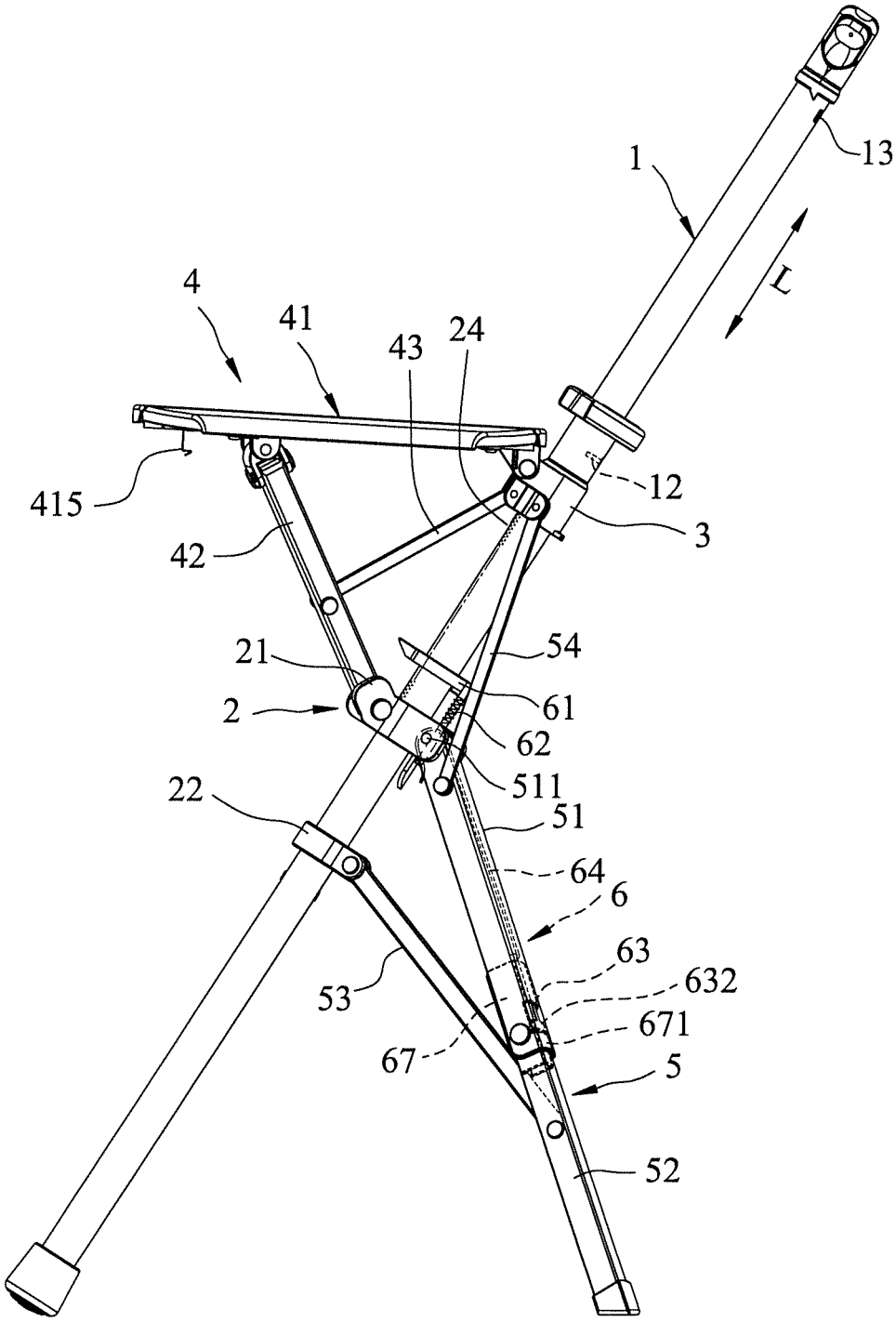
FIG. 2 is a side view of the embodiment.
Figure 3:
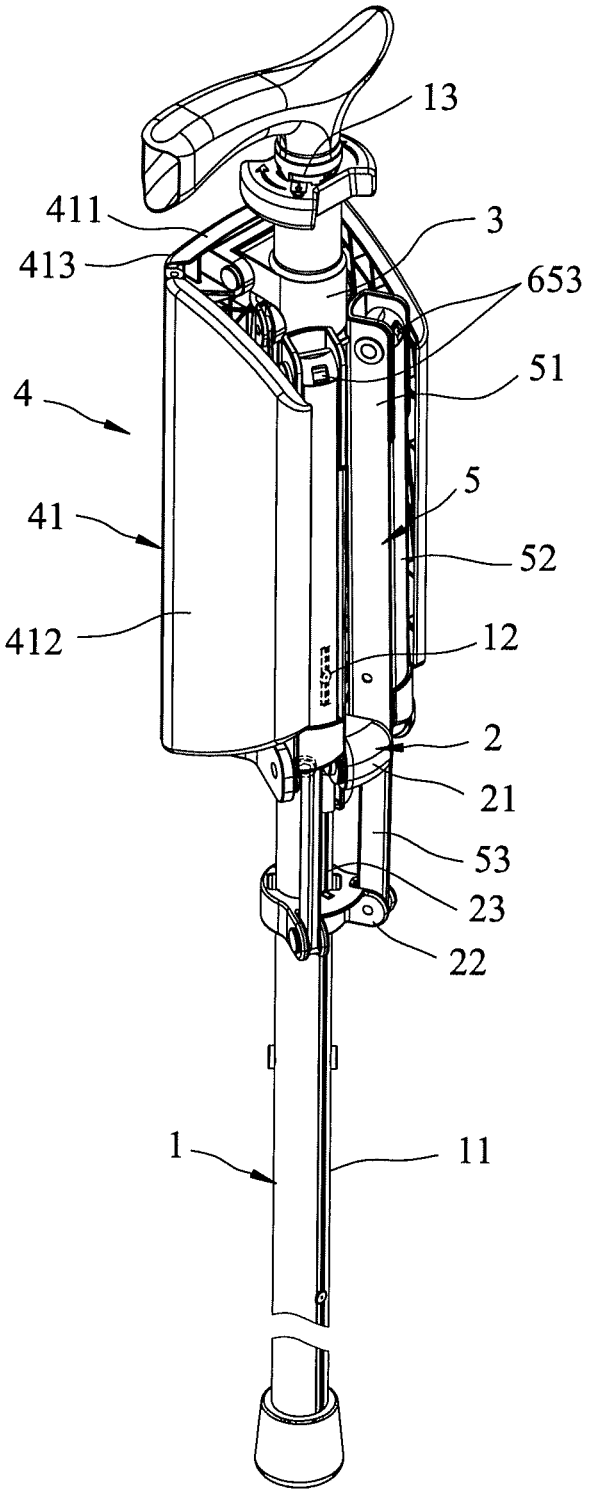
FIG. 3 is another perspective view of the embodiment illustrating the foldable chair being folded.
Figure 4:
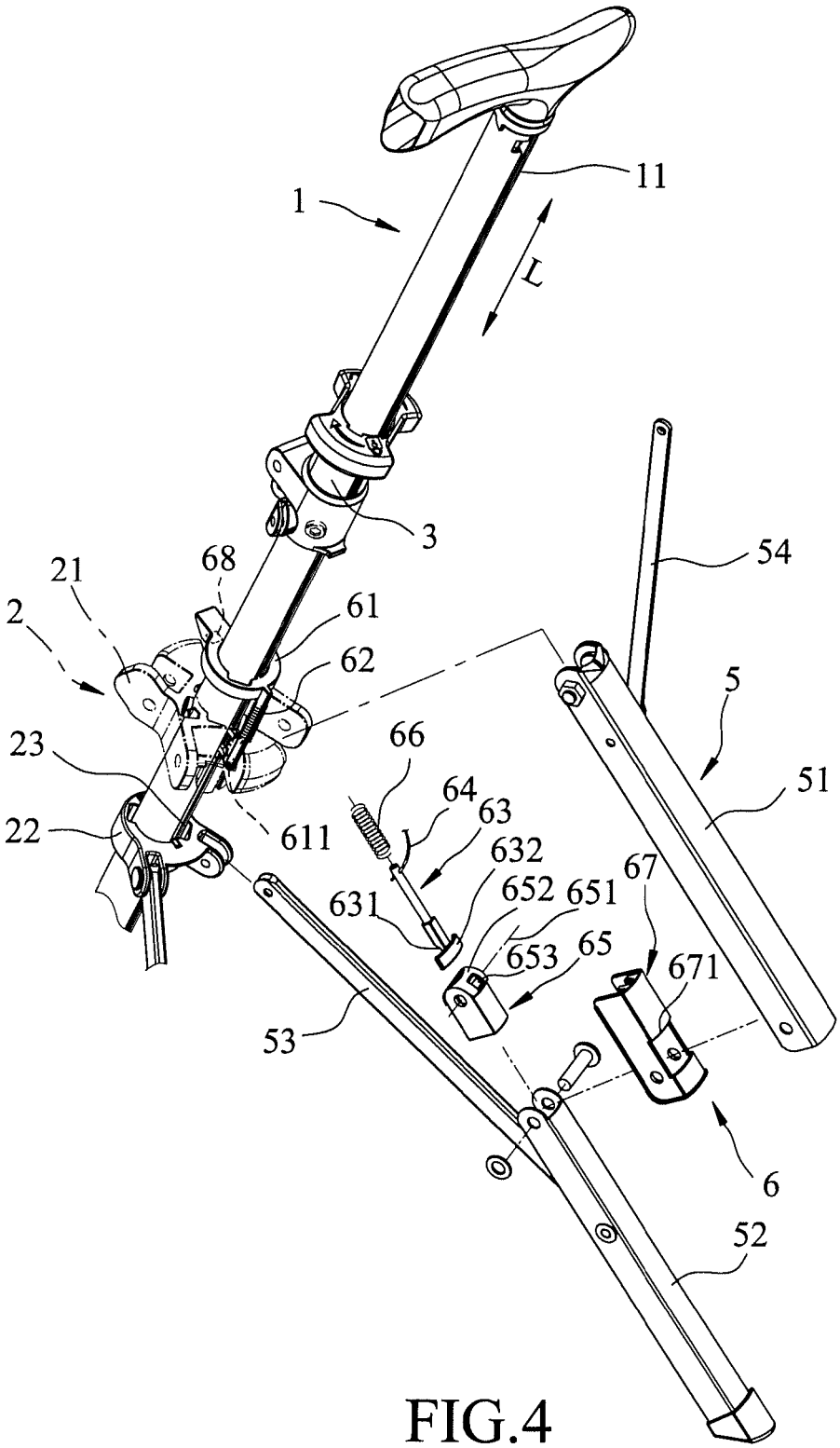
FIG. 4 is a partly exploded fragmentary perspective view of the embodiment.

As shown in FIGS. 1 to 3, the embodiment of a foldable chair according to the present disclosure is configured as a walking stick chair, and includes a main stick 1, a fold unit 2, a seat unit 4 and a retention unit 6.

Figure 8:
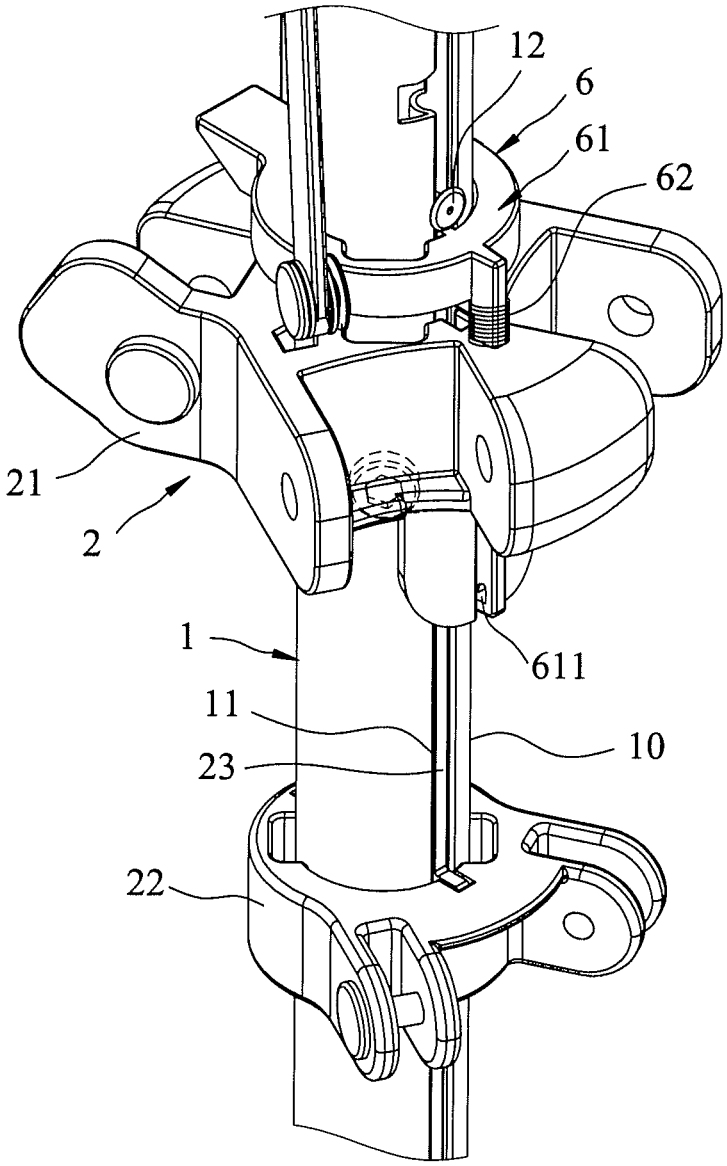
FIG. 8 is another fragmentary perspective view of the embodiment illustrating the middle slider member at the upper position.

Referring further to FIG. 8, the main stick 1 includes a rod body 10 and a limiting member 12. The rod body 10 extends along an axis (A), and is formed with a guide groove 11 that extends in a longitudinal direction (L) of the rod body 10. The limiting member 12 is disposed fixedly in the guide groove 11. In this embodiment, the rod body 10 is configured as a tubular rod that has a tubular wall. The guide groove 11 has a depth greater than the thickness of the tubular wall, and is configured to enhance the structural strength of the rod body 10.

The seat unit 4 includes a seat member 41 and an upper slider member 3.

The upper slider member 3 is movable along the rod body 10.

The seat member 41 includes a main plate 411 that has a proximal end portion 413 connected pivotally to the upper slider member 3, and a distal end portion 414 opposite to the proximal end portion 413, two lateral plates 412 that are connected respectively and pivotally to opposite lateral sides of the main plate 411, and a resilient hook 415 that is disposed at a bottom side of the main plate 411 and that is proximate to the distal end portion 414 of the main plate 411.

The fold unit 2 includes a middle slider member 21, a lower slider member 22, a connecting rod 23 (see FIG. 3), a slider resilient member 24 (see FIG. 2) and a leg unit 5.

The middle slider member 21 is disposed under upper the slider member 3, is movable along the rod body 10 between a lower position (see FIGS. 2 and 6) and an upper position (see FIG. 7) located above the lower position, and is located below the limiting member 12 of the main stick 1. The lower slider member 22 is movable along the rod body 10 and is disposed below the middle slider member 21. The connecting rod 23 interconnects co-movably the middle slider member 21 and the lower slider member 22.

The slider resilient member 24 is configured as a tension spring, and connected between the middle slider member 21 and the upper slider member 3 for biasing resiliently the middle and the upper slider members 21, 3 toward each other. Each of the middle slider member 21 and the upper slider member 3 has a portion engaging movably the guide groove 11 of the rod body 10.

The leg unit 5 includes two support legs each including an upper leg component 51 that is connected pivotally to the middle slider member 21 by a pivot pin 511 (see FIG. 2), a lower leg component 52 that is connected pivotally to the upper leg component 51, an auxiliary link 53 that has opposite ends connected respectively and pivotally to the lower slider member 22 and the lower leg component 52, and a drive link 54 that has opposite ends connected respectively and pivotally to the upper slider member 3 and the upper leg component 51.

Figure 9:
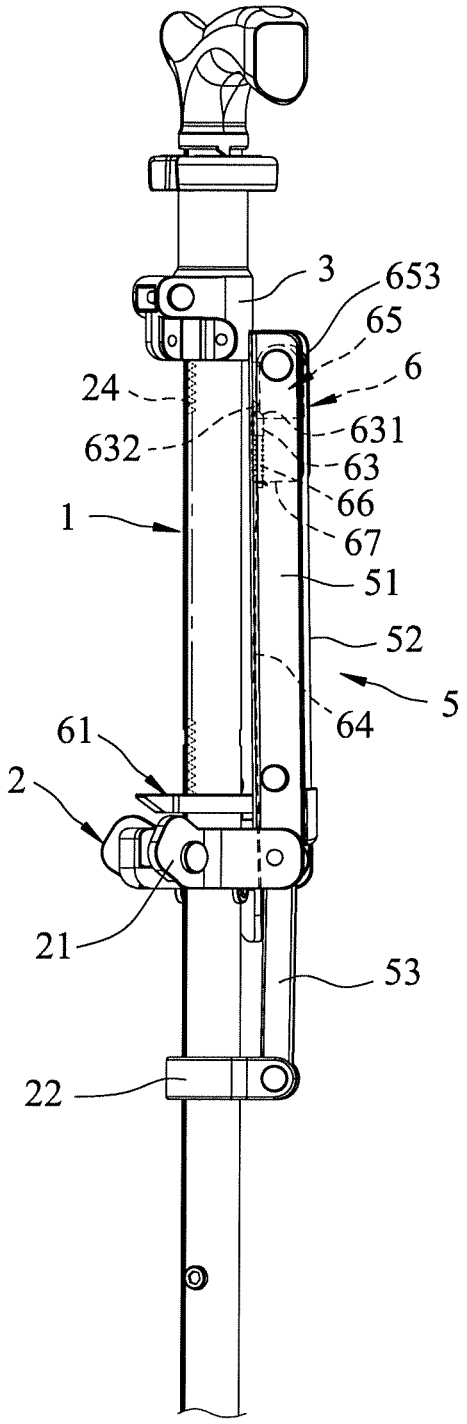
FIG. 9 is another fragmentary side view of the embodiment illustrating the foldable chair being folded.

The fold unit 2 is operable to convert between an unfolded state where the upper slider member 3 and the middle slider member 21 are proximate to each other and where a free end of the lower leg component 52 of each of the support legs is distal from the rod body 10 and the corresponding upper leg component 51 (see FIGS. 1 and 2), and a folded state where the upper slider member 3 and the middle slider member 21 are distal from each other so that the slider resilient member 24 is stretched and where the free end of the lower leg component 52 of each of the support legs is proximate to the rod body 10 and the corresponding upper leg component 51 (see FIGS. 3 and 9), such that when the fold unit 2 is converted from the unfolded state into the folded state, a distance between the upper and middle slider members 3, 21 is increased and the free end of each of the lower leg components 52 pivots toward the corresponding upper leg component 51.

The seat unit 4 further includes two fold bars 42 and two linking bars 43.

Each of the fold bars 42 has opposite ends connected respectively and pivotally to the middle slider member 21 and a respective one of the lateral plates 412 of the seat member 41. Each of the linking bars 43 has opposite ends connected respectively and pivotally to the upper slider member 3 and a respective one of the fold bars 42.

Referring to FIGS. 4 to 7, the retention unit 6 includes a cord seat 61, a seat resilient member 62, and two locking structures that correspond respectively to the support legs of the leg unit 5.

The cord seat 61 is disposed movably on the middle slider member 21, is disposed below the limiting member 12, and is movable relative to the middle slider member 21 in the longitudinal direction (L) of the rod body 10 between a released position (see FIGS. 5 and 6) and a pushed position (see FIGS. 7 and 8). The cord seat 61 is formed with a hook groove 68 that faces downwardly.

The seat resilient member 62 is configured as a compression spring, and is connected between the middle slider member 21 and the cord seat 61 for biasing resiliently the cord seat 61 to move upwardly relative to the middle slider member 21 toward the released position.

Each of the locking structures includes a latch member 63, a pull cord 64, a block member 65, a latch resilient member 66 and an installation seat 67. For simplification, one of the locking structures and the corresponding support leg thereof will be described in the following.

The installation seat 67 is connected fixedly to the upper leg component 51 and is formed with a limiting groove 671 that has two opposite closed ends.

The latch member 63 is connected movably to the upper leg component 51, and has an abutment surface 631 and a plate portion 632. The plate portion 632 is movable within the limiting groove 671 of the installation seat 67 between the two closed ends so as to limit the relative movement between the latch member 63 and the upper leg component 51.

Figure 5:
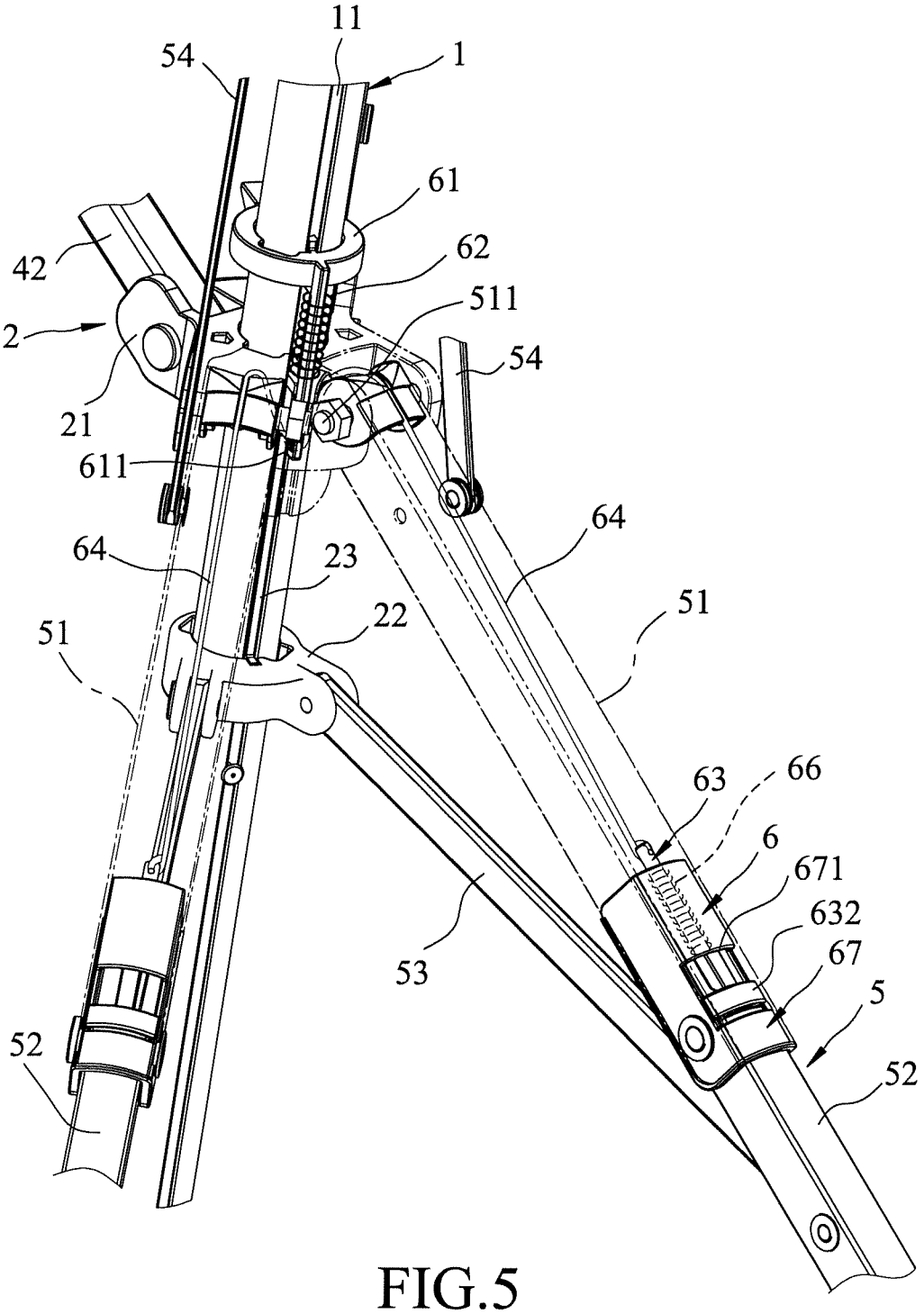
FIG. 5 is a fragmentary perspective view of the embodiment.

The pull cord 64 has a first end portion that is connected to the latch member 63, and a second end portion that is opposite to the first end portion and that extends around the pivot pin 511 (see FIG. 5). In this embodiment, the second end portions of the pull cords 64 of the locking structures are interconnected integrally, and extend through a cord hole 611 formed in the cord seat 61.

The block member 65 is connected co-movably to the lower leg component 52, and has a pivot axis 651 about which the lower leg component 52 is pivotable relative to the upper leg component 51, a contact surface 652 that extends around the pivot axis 651, and an engaging groove that is formed in the contact surface 652. The block member 65 further has a groove-defining surface that defines the engaging groove, and that has a bottom surface portion connected to the contact surface 652 and serving as an engaging surface 653. A distance between the engaging surface 653 and the pivot axis 651 is smaller than that between the contact surface 652 and the pivot axis 651. In this embodiment, the contact surface 652 of the block member 65 is configured as an arc surface that is centered at the pivot axis 651 of the block member 65.

The latch resilient member 66 is connected between the latch member 63 and the upper leg component 51 for biasing resiliently the latch member 63 toward the block member 65.

In this embodiment, the latch resilient member 66 of each of the locking structures is configured as a compression spring.

Figure 6:
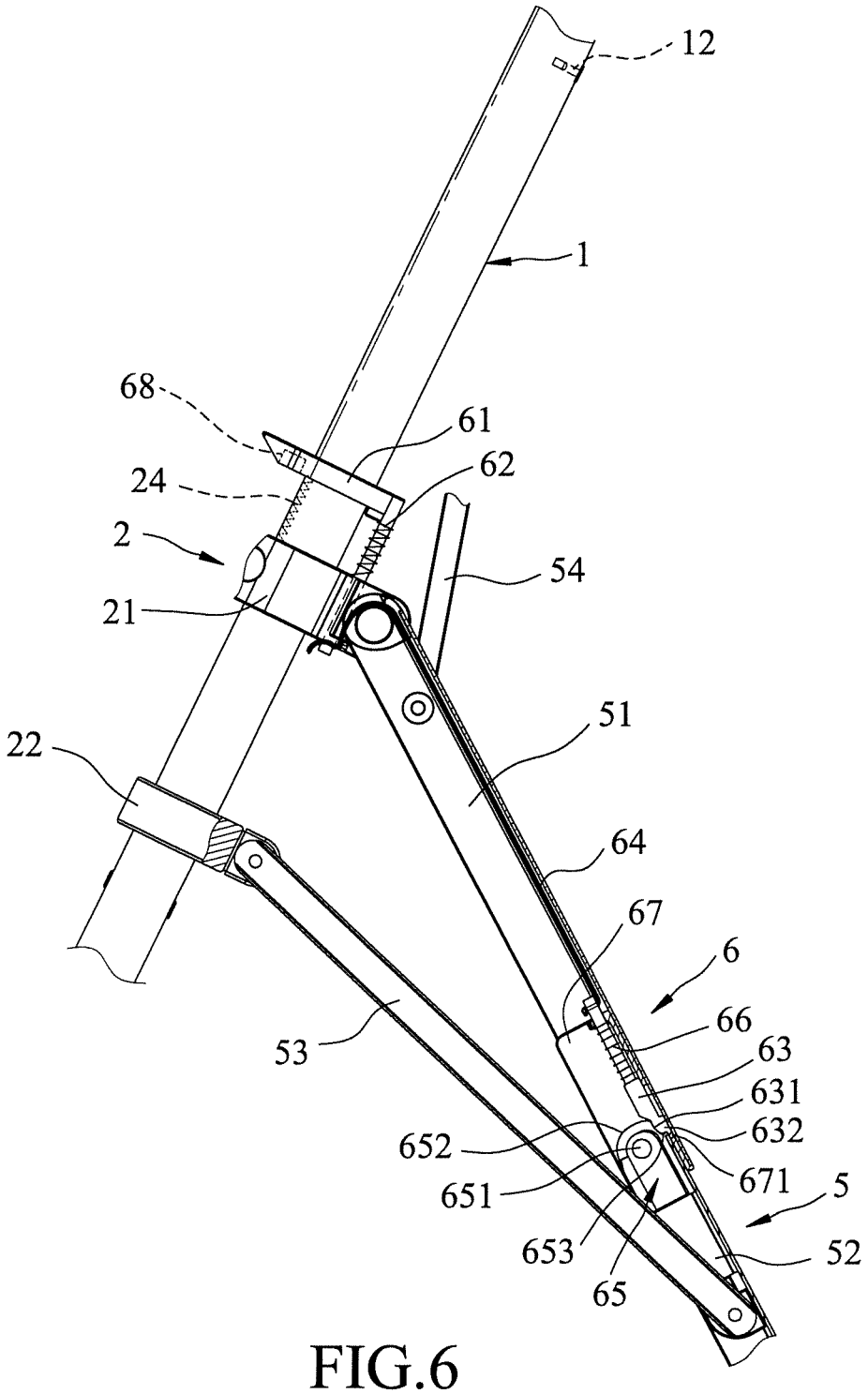
FIG. 6 is a fragmentary side view of the embodiment illustrating a middle slider member at a lower position.

Referring to FIGS. 1, 5 and 6, when the middle slider member 21 is at the lower position, and when the fold unit 2 is in the unfolded state, the latch member 63 is biased by the latch resilient member 6 to abut against the engaging surface 653 of the block member 65 for preventing the lower leg component 52 from pivoting relative to the upper leg component 51, so as to keep the support leg unfolded. At this time, the cord seat 61 is at the released position, the abutment surface 631 is in contact with the engaging surface 653. It is noted that when the support leg is unfolded, the upper and lower leg components 51, 52 of the support leg are aligned with each other. However, in a variation of this embodiment, when the support leg is unfolded, the upper and lower leg components 51, 52 of the support leg may form an arbitrary angle, say, 150 degrees.

To fold the foldable chair of this disclosure, the upper slider member 3 is moved upwardly relative to the main stick 1. It is noted that the middle and lower slider members 21, 22, the connecting rod 23, the upper and lower leg components 51, 52 and the auxiliary link 53 cooperatively form a four-bar linkage that has only one degree of freedom. Since the upper and lower leg components 51, 52 are prevented from pivoting relative to each other, the upward movement of the upper slider member 3 drives movement of the middle slider member 21 from the lower position toward the upper position via the drive link 54 and the upper leg component 51 while the fold unit 2 is kept unfolded.

Figure 7:
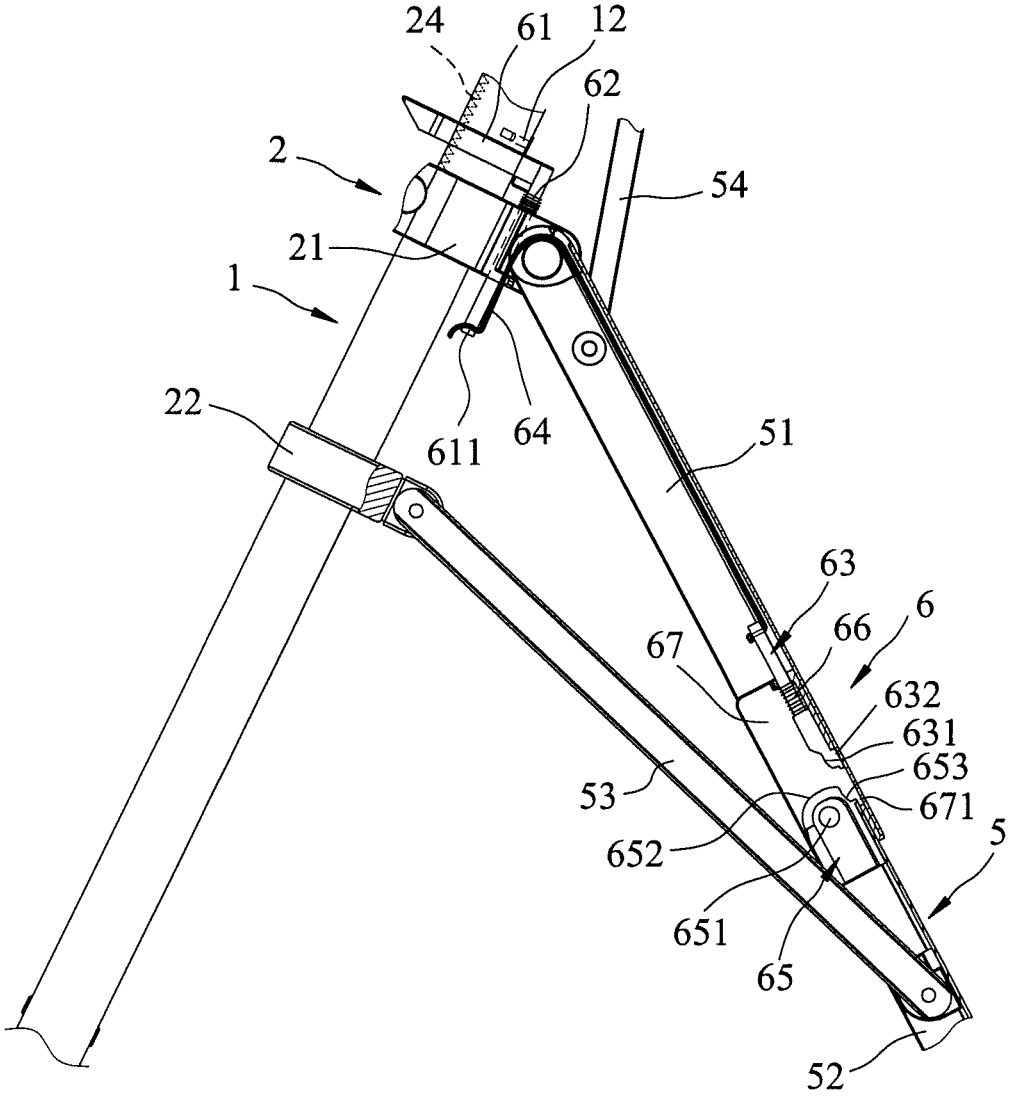
FIG. 7 is another fragmentary side view of the embodiment illustrating the middle slider member at an upper position.

Referring to FIGS. 7 and 8, when the middle slider member 21 is moved to the upper position, the cord seat 61 is pushed by the limiting member 12 to move downwardly relative to the middle slider member 21 against the biasing action of the seat resilient member 62 to the pushed position, and to therefore drive the pull cord 64 to separate the latch member 63 from the engaging surface 653 against the biasing action of the latch resilient member 66 (i.e., to compress the latch resilient member 66), so that the relative pivot movement between the upper and lower leg components 51, 52 is permitted. With further upward movement of the upper slider member 3, the fold unit 2 is converted from the unfolded state into the folded state (see FIG. 9).

During conversion of the fold unit 2 from the unfolded state to the folded state, the upper slider member 3 drives the fold bars 42 to pivot toward the rod body 10 via the linking bars 43, and the end of each of the fold bars 42 connected to the corresponding lateral plate 412 slides along a guide groove formed in the corresponding lateral plate 412. When the fold unit 2 is at the folded state, the main plate 411 and the lateral plates 412 cooperatively form a U-shaped structure to cover the support legs 12 of the fold unit 2.

Figure 10:
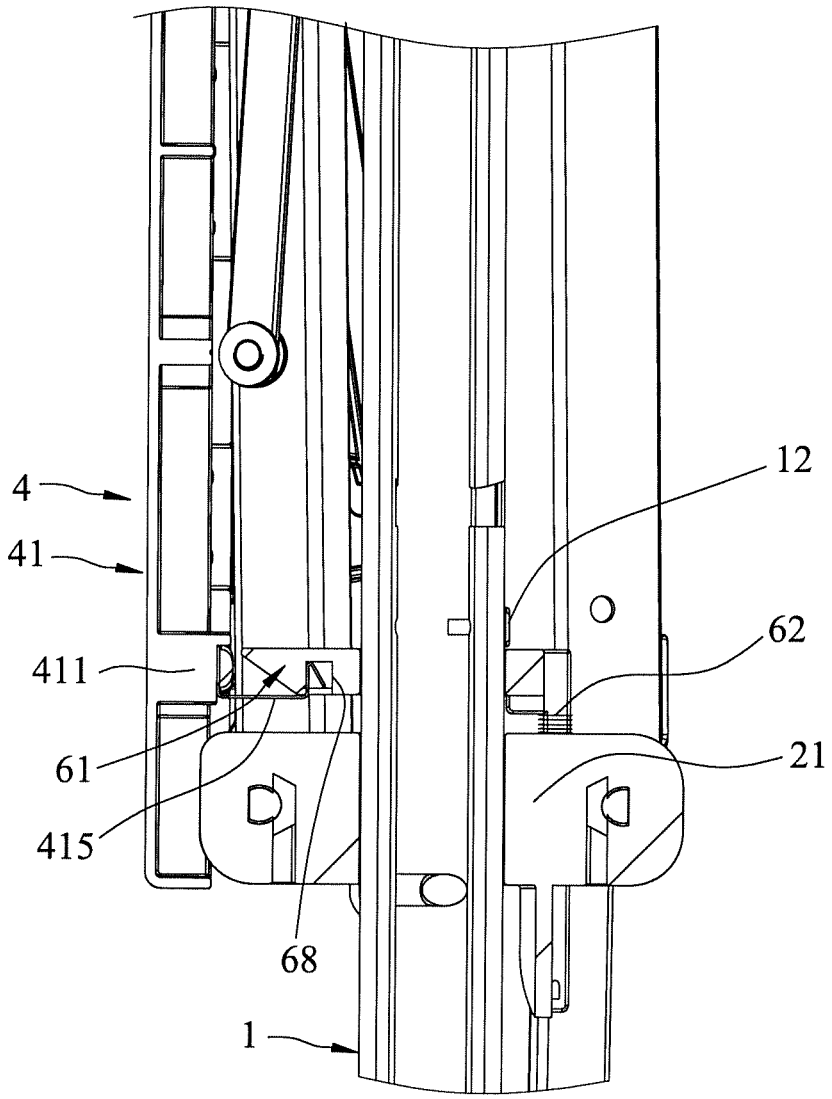
FIG. 10 is still another fragmentary side view of the embodiment illustrating the foldable chair being folded.

Referring to FIG. 10, when cord seat 61 is at the pushed position and when the fold unit 2 is in the folded state, the hook groove 68 of the cord seat 61 engages the resilient hook 415 so as to prevent movement of the seat unit 4 relative to the main stick 1.

To unfold the foldable chair, the upper slider member 3 is operated to disengage from a positioning groove 13 formed in the rod body 10, and is moved downwardly to drive the middle slider member 21 to move downwardly.

When the middle slider member 21 is moved away from the upper position, the cord seat 61 is spaced apart from the limiting member 12 and is biased by the seat resilient member 62 to move upwardly relative to the middle slider member 21 so as to disengage the hook groove 68 from the resilient hook 45 and to permit conversion of the fold unit 2 between the unfolded state and the folded state. Meanwhile, the latch resilient member 66 biases the latch member 63 to abut against the block member 65. In this embodiment, the abutment surface 631 of the latch member 63 is in line contact with the contact surface 652 of the block member 65 when the support leg is folded and when the middle slider member 21 is moved away from the upper position.

The advantages of this disclosure are as follows.

1. The latch member 63 of each of the locking structure is configured to prevent the relative pivot movement between the upper and lower leg components 51, 52 of the corresponding support leg directly.

2. By virtue of the configuration of the retention unit 6, the relative pivot movement between the upper and lower leg components 51, 52 of each of the support legs can be permitted or prevented through moving the upper slider member 3 along the rod body 10 of the main stick 1 simply.

While the present disclosure has been described in connection with what is considered the most practical embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A foldable chair comprising:

a main stick including a rod body that extends along an axis;

a seat unit connected to said rod body;

a fold unit including a middle slider member and a leg unit, said middle slider member being movable along said rod body between a lower position and an upper position that is located above the lower position, said leg unit including at least one support leg that includes an upper leg component connected pivotally to said middle slider member, a lower leg component connected pivotally to said upper leg component, and a drive link having opposite ends that are connected respectively to said seat unit and said upper leg component, said seat unit being operable to drive movement of said drive link so as to convert said fold unit between an unfolded state where a free end of said lower leg component is distal from said rod body and said upper leg component, and a folded state where said free end of said lower leg component is proximate to said rod body and said upper leg component, such that when said fold unit is converted from the unfolded state into the folded state, said free end of said lower leg component pivots toward said upper leg component; and a retention unit including at least one locking structure that includes a latch member, a pull cord and a block member, said latch member being connected movably to said upper leg component, said pull cord having a first end portion that is connected to said latch member, and a second end portion that is opposite to said first end portion and that is connected to said middle slider member, said block member being connected co-movably to said lower leg component, and having a pivot axis about which said lower leg component is pivotable relative to said upper leg component, a contact surface that extends around the pivot axis, and an engaging surface that is connected to said contact surface, a distance between said engaging surface and said pivot axis being smaller than that between said contact surface and said pivot axis;

wherein, when said middle slider member is at the lower position and said fold unit is in the unfolded state, said latch member abuts against said engaging surface for preventing said lower leg component from pivoting relative to said upper leg component so as to keep said support leg unfolded; and wherein, when said middle slider member is moved to the upper position, said pull cord is configured to be driven to separate said latch member from said engaging surface for permitting said lower leg component to pivot relative to said upper leg component so as to permit conversion of said fold unit from the unfolded state to the folded state.

2. The foldable chair as claimed in claim 1, wherein said locking structure further includes a latch resilient member connected between said latch member and said upper leg component of said support leg for biasing resiliently said latch member toward said block member.

3. The foldable chair as claimed in claim 2, wherein said retention unit further includes a cord seat connected movably to said middle slider member, said second end portion of said pull cord being connected to said cord seat.

4. The foldable chair as claimed in claim 2, wherein said latch resilient member of said locking structure is configured as a compression spring that is compressed when said middle slider member is at the upper position.

5. The foldable chair as claimed in claim 1, wherein, when said support leg is unfolded, said upper and lower leg components of said support leg are aligned with each other.

6. The foldable chair as claimed in claim 1, wherein said latch member has an abutment surface, said abutment surface being in contact with said engaging surface when said latch member abuts against said engaging surface, said abutment surface being in line contact with said contact surface of said block member when said support leg is folded and said middle slider member is moved away from the upper position.

7. The foldable chair as claimed in claim 1, wherein said locking structure further includes an installation seat that is connected fixedly to said upper leg component and that is formed with a limiting groove having two opposite closed ends, said latch member further having a plate portion that is movable within said limiting groove between said closed ends so as to limit the relative movement between said latch member and said upper leg component.

8. The foldable chair as claimed in claim 1, wherein said fold unit further includes a lower slider member that is movable along said rod body and that is disposed below said middle slider member, said support leg further including an auxiliary link that has opposite ends connected respectively and pivotally to said lower slider member and said lower leg component, said latch member being in contact with said contact surface of said block member when said support leg is folded and said middle slider member is moved away from the upper position.

9. The foldable chair as claimed in claim 8, wherein said rod body is formed with a guide groove that extends in a longitudinal direction of said rod body, said main stick further including a limiting member that is disposed fixedly in said guide groove and that is located above said middle slider member, said fold unit further including a connecting rod that interconnects co-movably said middle and lower slider members, said cord seat being pushed by said limiting member to move downwardly relative to said middle slider member when said middle slider member is moved to the upper position, so that said cord seat drives said pull cord to separate said latch member from said engaging surface against the biasing action of said latch resilient member, said cord seat being spaced apart from said limiting member when said middle slider member is moved away from the upper position, so that said latch resilient member biases said latch member to abut against said block member.

10. The foldable chair as claimed in claim 1, wherein said seat unit includes an upper slider member that is movable along said rod body and that is disposed above said middle slider member, and a seat member that is connected to said upper slider member, said drive link having said opposite ends connected respectively and pivotally to said upper slider member and said upper leg component.

11. The foldable chair as claimed in claim 1, wherein said contact surface of said block member is configured as an arc surface that is centered at said pivot axis of said block member.

12. The foldable chair as claimed in claim 1, wherein said leg unit of said fold unit includes two said support legs, said retention unit including two said locking structures that correspond respectively to said support legs, said second end portions of said pull cords of said locking structures being interconnected integrally.

13. A locking structure adapted to be used in a foldable linkage unit, the linkage unit including pivotally-interconnected first and second links, said locking structure comprising:

a latch member connected movably to the first link;

a block member connected co-movably to the second link, and having a pivot axis about which the second link is pivotable relative to the first link, a contact surface that extends around the pivot axis, and an engaging surface that is connected to said contact surface, a distance between said engaging surface and said pivot axis being smaller than that between said contact surface and said pivot axis, said latch member being operable to abut against said engaging surface for preventing the second link from pivoting relative to the first link, and to be separated from said engaging surface for permitting the second link to pivot relative to the first link; and a resilient member connected between said latch member and the first link for biasing resiliently said latch member toward said block member;

wherein said latch member has an abutment surface, said abutment surface being in contact with said engaging surface when said latch member abuts against said engaging surface, said abutment surface being in line contact with said contact surface of said block member when the linkage unit is folded.

14. The locking structure as claimed in claim 13, said resilient member is configured as a compression spring that is compressed when said latch member is separated from said engaging surface.

15. The locking structure as claimed in claim 13, further comprising a pull cord that is connected to said latch member for being pulled to drive movement of said latch member relative to the first link.

16. The locking structure as claimed in claim 13, wherein said block member is configured such that when said latch member abuts said engaging surface, the first and second links are aligned with each other.

17. The locking structure as claimed in claim 13, further comprising an installation seat that is connected fixedly to the first link and that is formed with a limiting groove having two opposite closed ends, said latch member further having a plate portion that is movable within said limiting groove between said closed ends so as to limit the relative movement between said latch member and the first link.

18. The locking structure as claimed in claim 13, wherein said contact surface of said block member is configured as an arc surface that is centered at said pivot axis of said block member.

* * * * *